United States Patent [19]

Patil et al.

[11] 4,262,602

[45] Apr. 21, 1981

[54] COVERED HOPPER CAR PARTITION ATTACHMENT STIFFNESS SHEET MODIFIER

[75] Inventors: Babgaunda A. Patil, Birmingham, Ala.; Phillip G. Przybylinski, Schererville, Ind.

[73] Assignee: Pullman Incorporated, Chicago, Ill.

[21] Appl. No.: 88,268

[22] Filed: Oct. 25, 1979

[51] Int. Cl.[3] ..... B61D 7/00

[52] U.S. Cl. ..... 105/248; 52/53; 105/406 R; 220/22

[58] Field of Search ..... 105/247, 248, 358, 360, 105/406 R, 409, 239, 374, 377, 396, 404; 52/41-56; 280/5 R, 5 C, 5 D, 5 E; 220/20, 22, DIG. 24

[56] References Cited

U.S. PATENT DOCUMENTS

| | | | |
|---|---|---|---|
| 773,954 | 11/1904 | Maltby | 52/48 X |
| 784,817 | 3/1905 | Trapp | 105/360 |
| 1,101,824 | 6/1914 | Whyte | 52/41 |
| 2,239,507 | 4/1941 | Pierce | 280/5 D |
| 3,572,252 | 3/1971 | Coover et al. | 105/248 |
| 3,583,331 | 6/1971 | Mowatt-Larssen | 105/248 X |
| 3,678,867 | 7/1972 | Brinks et al. | 105/377 |
| 3,789,773 | 2/1974 | McNally et al. | 105/248 |

*Primary Examiner*—Randolph A. Reese
*Attorney, Agent, or Firm*—Paul A. Kerstein

[57] ABSTRACT

A covered railway hopper car includes a partition sheet assembly, including a plurality of partition sheets rigidly connected to the roof, each having a construction at its upper ends which provides improved fatigue characteristics in the vicinity of the roof step and coaming area adjacent to the hatch opening area thereby relieving stress and reducing fatigue fractures.

8 Claims, 5 Drawing Figures

COVERED HOPPER CAR PARTITION ATTACHMENT STIFFNESS SHEET MODIFIER

BACKGROUND OF THE INVENTION

1. Field of the Invention

The invention relates to railway cars and particularly to a roof and partition sheet structure in the area of a roof step, upstanding coaming and hatch opening.

2. Description of the Prior Art

The prior art includes U.S. Pat. No. 1,101,824 which discloses a carline of channel bars of a certain configuration with a cutaway portion to form an access into the channel.

The prior art also includes partition sheet assemblies that divide covered railway hopper cars into compartments. The partition sheet assemblies are attached at their upper portions to overhead framing members usually by welding. When the partition sheet assemblies are subjected to a force they are caused to flex. It is this cyclic flexing which causes hard spots and stress concentrations culminating in fatigue fractures in the upper areas of the partition sheets of the prior art.

The present invention is an improvement over the prior art by the inclusion of elongated openings in the partition sheet assemblies in the areas of high stress concentrations reducing stiffness in those areas thereby relieving stress concentrations and improving fatigue characteristics, while still allowing the partition sheet assemblies to act as a roof support element and a stiffening element for the top framing bar.

SUMMARY OF THE INVENTION

In the present invention covered railway hopper cars include a plurality of partition sheet assemblies. These partition sheet assemblies are secured rigidly at their upper ends to a top framing bar. The partition sheet assemblies act as compartment dividers, roof support elements, stiffening elements for the top framing bar and load restraining devices.

The forces created during the coupling-uncoupling operation of railway vehicles and during acceleration, cause loads which the partition sheet assembly must restrain. To restrain the load each partition sheet assembly flexes, much like a membrane. Since the partition sheet assembly is rigidly attached to the top framing bar it must act as a unit in the flexing mode or fail. Therefore, when the partition sheet assembly flexes the top framing bar rotates. It is this rotation of the top framing bar which reduces stress concentrations in the partition sheet preventing fatigue fractures.

The top framing bar is prevented from rotating in the area of its intersection with the roof step, upstanding coaming and hatch opening. This causes a high degree of stress concentration in the partition sheet assembly just below the roof step, and upstanding coaming area adjacent to the hatch opening causing premature fatigue cracking under cyclic flexing.

To improve the fatigue characteristics in the partition sheet assembly, elongated openings are placed in the partition sheet assembly. These openings are placed in the area of the intersection of the roof step, upstanding coaming and hatch opening with the top framing bar, but sufficiently away from the top framing bar. These elongated openings modify the stiffness of the partition sheet assembly in said high stress areas relieving stress concentrations and improving fatigue characteristics while still allowing the partition sheet assembly to act in its capacity as a roof support element and top framing bar stiffener.

DESCRIPTION OF THE PREFERRED EMBODIMENT

Figure 1:
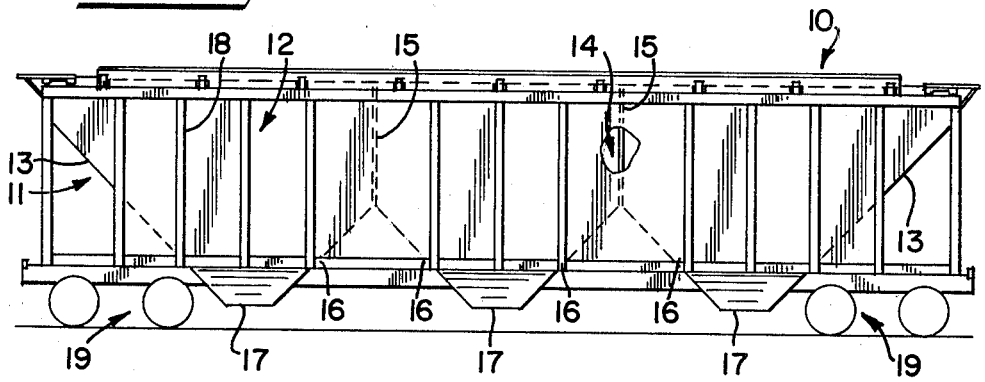
FIG. 1 is a side elevational view of a covered railway hopper car.

FIG. 1 discloses a covered railway hopper car generally designated by reference numeral 10. The covered railway hopper car 10 includes a body 11 having side walls 12. Connected to opposite ends of the side walls 12 are end walls 13 which slope downwardly. The hoppers 14 include partition sheet assemblies 15 and downwardly sloping sheets 16 leading to discharge openings 17. The side walls 12 are also provided with the usual type of vertical posts 18. The car body 11 is supported on conventional wheel trucks generally designated at 19.

Figure 2:
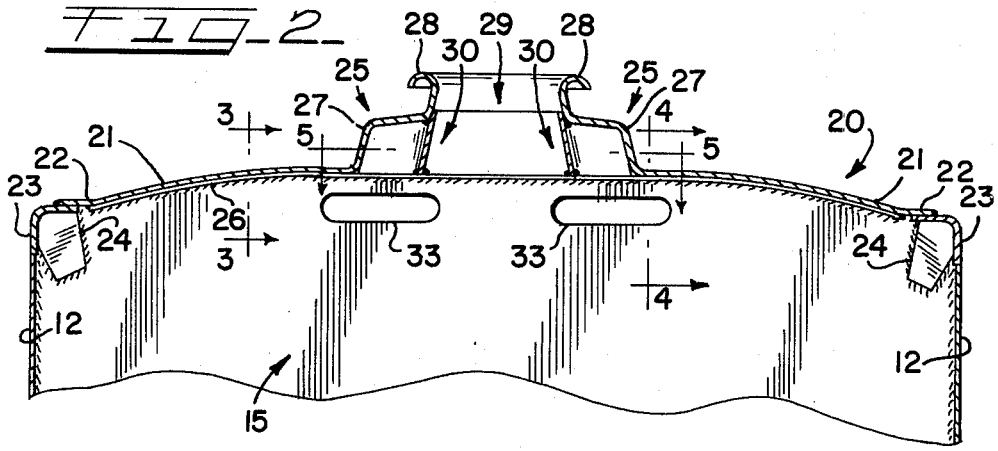
FIG. 2 is a section through a portion of a covered railway hopper car.

As best shown in FIG. 2 is a roof generally designated as reference numeral 20. The roof 20 consists of a roof sheet 21 having flanges 22 at its outer ends. The flanges 22 are connected to top side plates 23 which are connected to the side walls 12, all by means of gussets 24. The roof sheet 21 extends laterally from its flanges 22 to a roof step and upstanding coaming area generally designated as 25. The roof sheet 21 is attached to a top framing bar 26. The roof step portion 27 rises into an upstanding coaming 28 including an elongated hatch opening 29.

Figure 5:
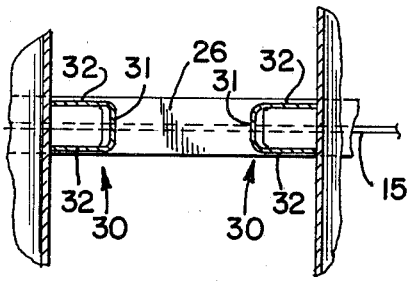
FIG. 5 is a section taken along line 5—5 of FIG. 2.

FIGS. 2 and 5 show U-shaped shields generally designated as reference numeral 30. The U-shaped shields are elements having a central flange 31 and laterally spaced leg members 32 connected to the central flange 31. The U-shaped shields 30 are welded to the top framing bar 26 having the central flange 31 adjacent to the hatch opening 29 and the laterally spaced leg members 32 within the roof step portion 27. The U-shaped shields 30 prevent the collection of material along the top framing bar 26 beneath the roof step and upstanding coaming area 25.

Figure 4:
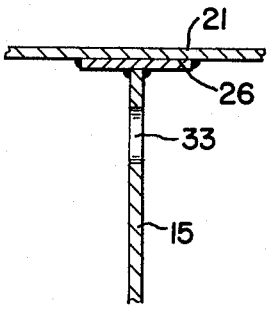
FIG. 4 is a section taken along the line 4—4 of FIG. 2.
Figure 3:
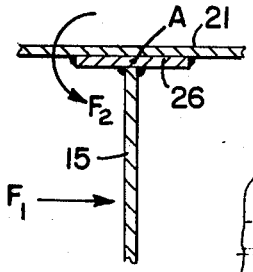
FIG. 3 is a section taken along line 3—3 of FIG. 2.

FIGS. 2 and 4 show the partition sheet assembly 15 welded at its upper ends to the top framing bar 26. A plurality of elongated openings 33 are placed at the upper end of the partition sheet assembly 15 below the roof step portion 27, upstanding coaming 28, and hatch opening 29, substantially adjacent to and beneath the top framing bar 26. The ends of the elongated openings 33 are to be disposed between a point below the roof sheet 21 adjacent to its rise into the roof step portion 27 and a point below the area of the hatch opening 29 adjacent to the area of the roof step portion 27 rising into the upstanding coaming 28. The partition sheet assembly 15 and top framing bar 26 are rigidly attached and must act as a unit under load or fail. FIG. 3 instructs that while the partition sheet assembly 15 flexes under load $F_1$, the top framing bar 26 rotates about its axis A under load $F_2$, thus relieving stress concentrations which would lead to fatigue cracking. The top framing bar 26 is restricted in its rotation in the roof step portion 27 and upstanding coaming 28 area adjacent to the hatch opening 29 thereby creating hard spots in the partition sheet assembly 15 leading to fatigue cracks. In the present invention, the elongated openings 33 placed as hereinabove described act as stiffness modifiers allowing the partition sheet assembly 15 to flex under load in the area of the roof step portion 27 and upstanding coaming 28 without stress concentration thereby improving fatigue characteristics. The specified placement of the elongated openings 33 also allow the partition sheet assembly 15 to act in its function as a roof support member and a stiffening element for the top framing bar.

What is claimed is:

1. A railway hopper car including a body having sidewalls, a hopper and a roof sheet including flanges at its outer edges, a top side plate connected to the flanges and the sidewalls, said roof sheet including an elongated roof step portion having an upstanding coaming including a hatch opening, and a top framing bar connected to the underneath portion of said roof sheet, the improvement comprising:

a partition sheet assembly extending vertically within said hopper, means for connecting said partition sheet assembly at its upper end to said top framing bar, and said partition sheet assembly including at its upper end means for providing flexure thereby acting to minimize the stiffening effect of said roof step portion contiguous with said top framing bar to enhance uniform flexure of said partition sheet assembly for reducing stress concentrations therein.

2. The partition sheet assembly in accordance with claim 1, said means for providing flexure being placed at the upper end of said partition sheet assembly substantially adjacent to and beneath the top framing bar.

3. The partition sheet assembly in accordance with claim 2, said means for providing flexure being placed beneath the roof step portion and upstanding coaming adjacent to the hatch opening.

4. The partition sheet assembly in accordance with claim 3, said means for providing flexure being a plurality of elongated openings.

5. The partition sheet assembly in accordance with claim 4, said means for providing flexure being a plurality of elongated openings being disposed between a point below the roof sheet adjacent to its rise into the roof step portion and a point below the area of the hatch opening adjacent to the area of the roof step portion rising into the upstanding coaming.

6. The partition sheet assembly in accordance with claim 1, including a gusset, said assembly being connected to the sidewall and top side plate by said gusset.

7. The partition sheet assembly in accordance with claim 1, including a shielding means rigidly fixed to the top framing bar.

8. The partition sheet assembly in accordance with claim 7, said shielding means including a central flange and laterally spaced leg members connected to said central flange, said leg members being laterally spaced within said hatch opening and said legs being positioned within said roof step portion and said central flange positioned adjacent to said hatch opening.

* * * * *